United States Patent [19]

Wei

[11] Patent Number: 5,027,037

[45] Date of Patent: Jun. 25, 1991

[54] CONTROLLER FOR CONTINUOUS TRACING LIGHTS

[75] Inventor: Shih A. Wei, Taipei, Taiwan

[73] Assignee: Tone World International Corp., Taipei, Taiwan

[21] Appl. No.: 461,429

[22] Filed: Jan. 5, 1990

[51] Int. Cl.[5] ..... H05B 39/04

[52] U.S. Cl. ..... 315/200 A; 315/323; 315/185 S

[58] Field of Search ..... 315/200 R, 200 A, 201, 315/307, 323, 360, 185 S, 185 R; 362/806

[56] References Cited

U.S. PATENT DOCUMENTS 4,713,586 12/1987 Chiang ..... 315/200 A 4,890,000 12/1989 Chou ..... 315/323 X

*Primary Examiner*—Eugene R. LaRoche

*Assistant Examiner*—Ali Neyzari

*Attorney, Agent, or Firm*—Cushman, Darby & Cushman

[57] ABSTRACT

A continuous tracing light controller for controlling the flashing of a plurality of bulbs comprising:

a bridge rectifier for the conversion of AC to DC;

an inverter phase circuit for the reverting of the above obtained DC; and a programmable central control integrated circuit having a plurality of outputs for the individual controlling of bulbs in series, a three step switch and 3 variable resistors being connected to said integrated circuit. The controller controls the lighting pattern in a fully lighted, forward tracing or backward reversing pattern. The way of controlling of the controller is by means of Pulse Width Modulation in which a pulse wave synchronized with a current is input and by use of a counting pulse to control the time sequence of the input pulse. By controlling the response time delay of the individual wave such that the individual light bulb responds at different time so as to produce visual effects for which the bulbs are lighted in a continuous tracing manner.

1 Claim, 4 Drawing Sheets

CONTROLLER FOR CONTINUOUS TRACING LIGHTS

BACKGROUND OF INVENTION

The present invention relates to a controller for tracing lights, in particular, to a controller for lighting means or Christmas lighting by means of Pulse Width Modulation (PWM).

Currently, Christmas lighting has been widely used by families for decoration during the Christmas season or other occasions for celebration. Therefore, the variation in lighting patterns has been designed so as to promote sales. In conventional lighting, the controllers used for Christmas lighting are numerous. For instance, controllers which enable the light bulbs to flash intermittently, to light up entirely or to flash continuously in a forward tracing or backward reversing manner. The controllers for the tracing patterns of these lighting devices use a counter or the combination of counters with other electronic components. In order to fulfill the above multiple flashing patterns of the lighting device, various electronic components or integrated circuits are usually employed to form the controller for the light bulbs of the lighting device. As a result, the cost of manufacturing for the controllers is increased and the size of the controller is also greatly increased. Such a controller is not economical in view of structure.

SUMMARY OF THE PRESENT INVENTION

Therefore, it is an object of the present invention to provide a controller for tracing light bulbs which can control the lighting pattern in a fully lighted, forward tracing or backward reversing pattern. The way of controlling of the controller is by means of Pulse Width Modulation, which provides a pulse wave synchronized with a power source and uses a counting pulse to control the sequence of the input pulse. PWM also controls the response time delay of the individual pulse wave so that the individual light bulb responds at different time so as to produce the visual effects for which the bulbs are lighted in a continuous tracing manner.

BRIEF DESCRIPTION OF THE DRAWINGS

FIG. 2-1 and 2-2 illustrate the input wave forms and the pulse wave diagram obtained by PWM sampling;

DETAILED DESCRIPTION OF THE PREFERRED EMBODIMENT

Figure 1:
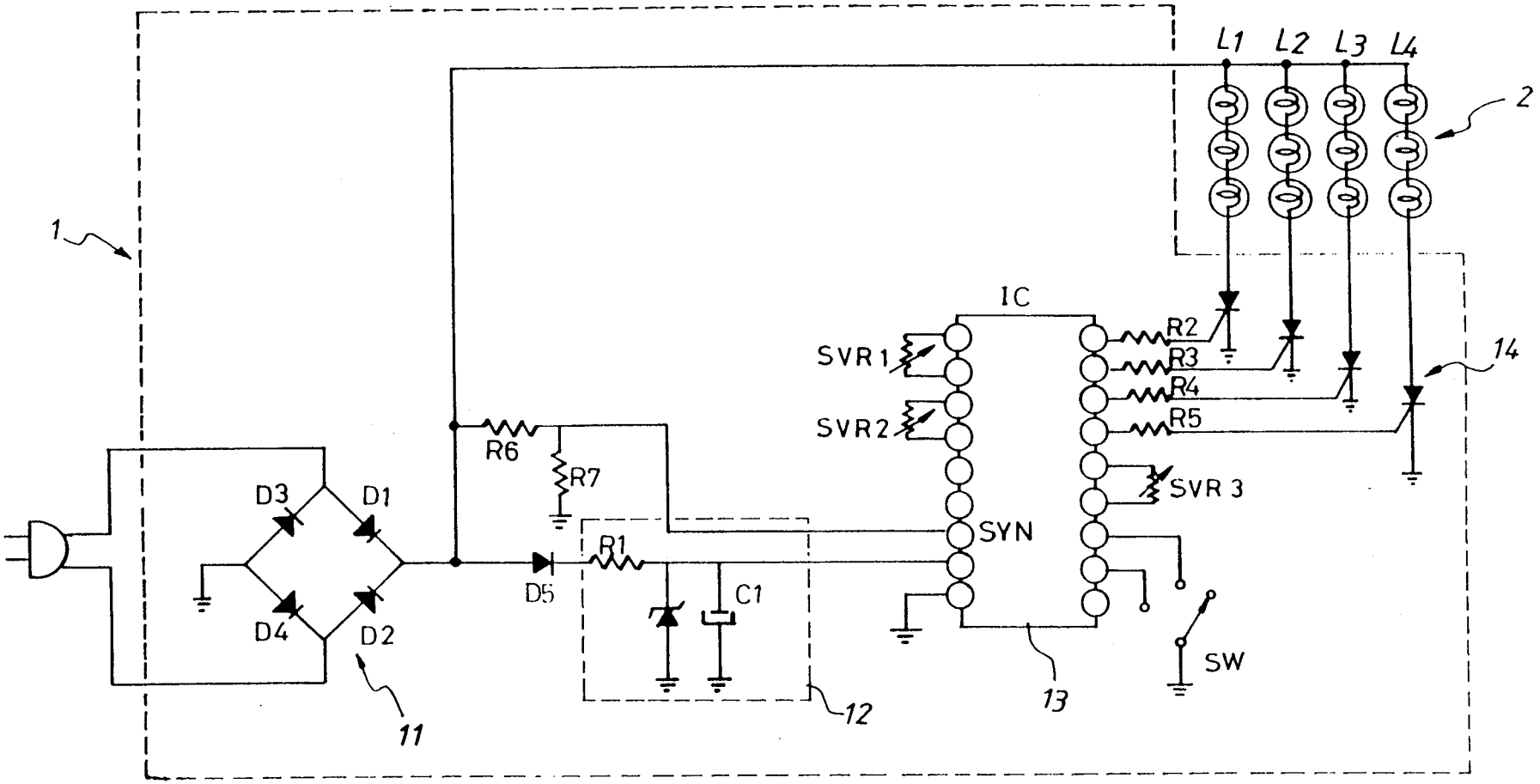
FIG. 1 illustrates the circuit diagram of the controller in accordance with the present invention.

As shown in FIG. 1, the controller, in accordance with the present, invention, comprises a bridge rectifier 11, an inverter circuit 12, a programmable central control integrated circuit 13 and a plurality of silicon-controlled rectifiers 14 for controlling of the flashing of light bulbs. (This rectifier 14 can be substituted by a MOSFET and high voltage transistor.) The input power source passes through the bridge rectifier 11 and an inverter circuit 12 to provide D.C. power to the above-mentioned central control integrated circuit 13. The current output from the bridge rectifier 11 is branched into another circuit to provide a signal (SYN) synchronized with the input current to the central control integrated circuit 13. The controller 1 of the present invention further comprises three variable resistors SVR1, SVR2, SVR3 and a switch SW for controlling the fully lighted, forward continuous tracing lighting and backward reversing lighting.

Figures 1, 2:
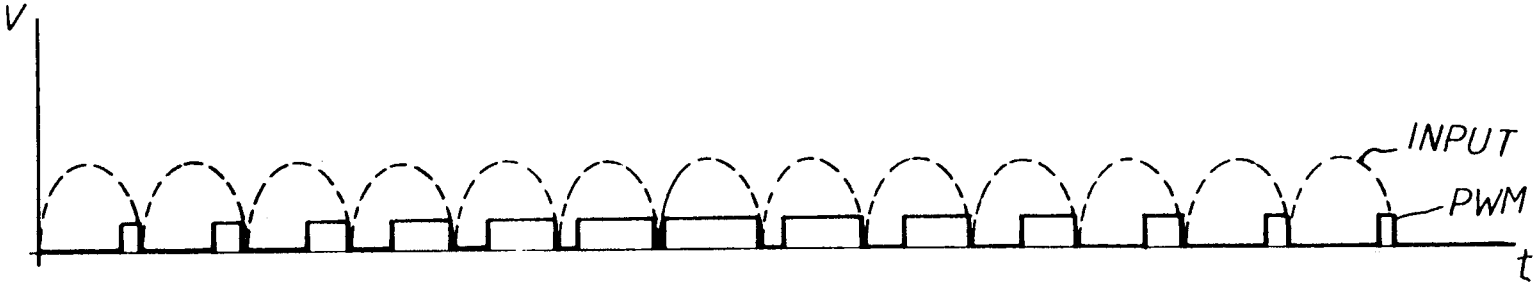
Figure 2:
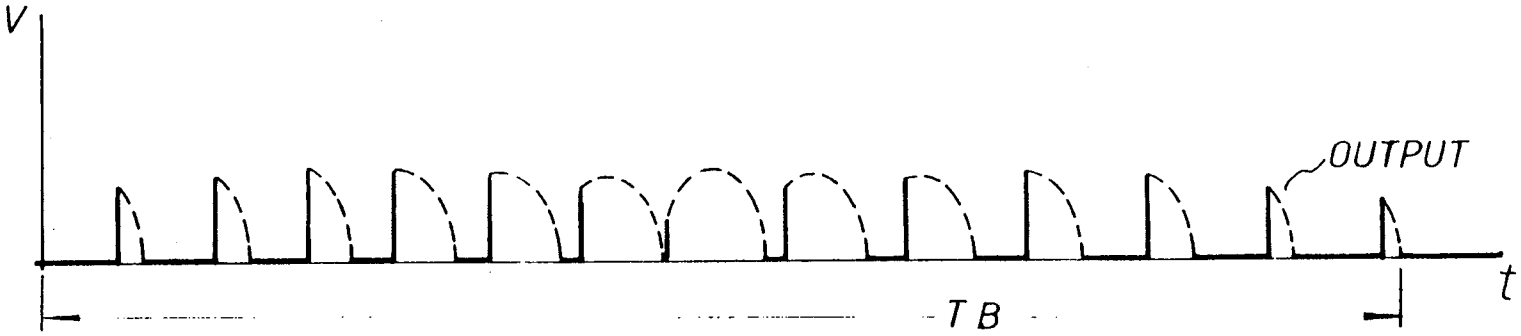

The synchronized signal in accordance with the present invention is achieved by Pulse Width Modulation in sampling. Initially, a pulse wave is selected by a signal generator and provided to an oscillator circuit with a clock signal. According to the sampling of the above pulse and clock signal, a modulated pulse wave output (abbreviated as PWM pulse wave) is obtained. This PWM pulse wave can be used to control the flashing mode of the bulbs of the lighting device. The flashing mode is shown in FIG. 2-1 and 2-2. In FIG. 2-1, the dashed line wave form represents the input voltage wave form after being rectified. In the figure., the square wave represents the sampling wave form (as a synchronized pulse wave of input voltage) by the PWM. Owing to the inverting action on the input wave form, an impulse activation is formed at the falling edge of the pulse. As shown in the figure, by the use of PWM technique, the sampled synchronized pulse wave is modulated by the PWM technique modulation. That is, it is a way of modulation where the pulse width is widened from narrow to wide, and then further narrowed. As a result, the output wave form (as shown in FIG. 2-2) has a weak, weaker, strong, stronger, and weak period $T_B$. The output wave form is output terminal at $OP_1$ of the central control Integrated Circuit 13 to drive the first group of light bulbs L1 such that the bulbs flash in a period from weak brightness to strong brightness, and then weakened from strong brightness to extinguish. The period $T_B$ can be varied by the first variable resistor SVR1 of the central control IC 13, so as to change the interval of flashing.

Figure 3:
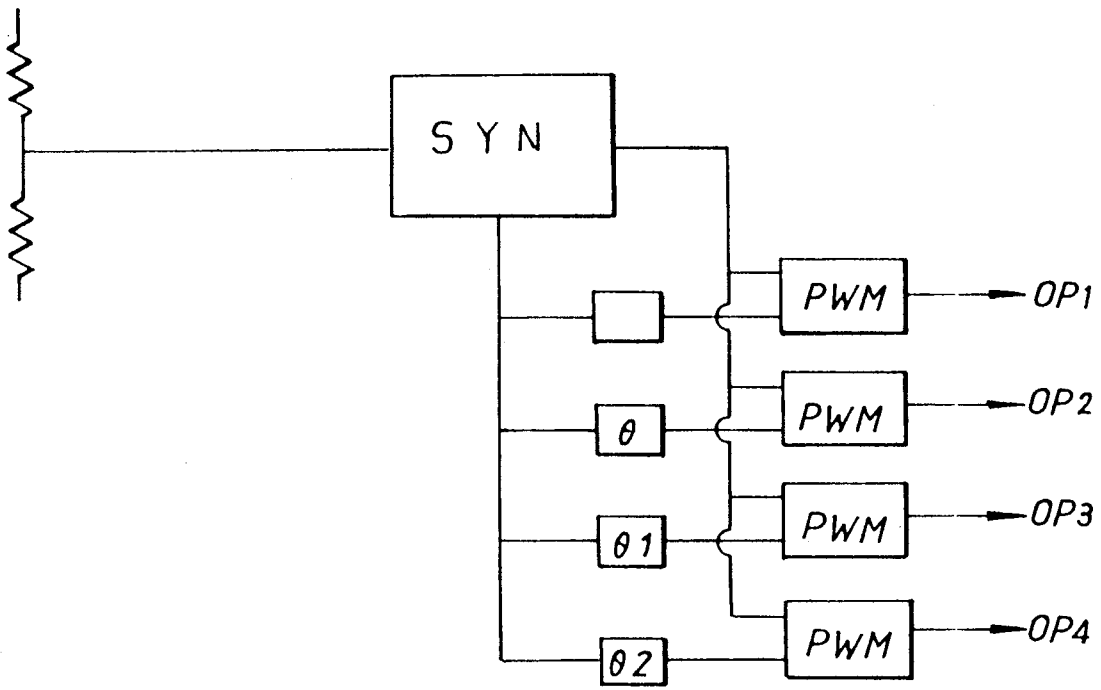
FIG. 3 illustrates the block diagram of PWM in accordance with the present invention.

After the first group of light bulbs L1 is driven by said output at $OP_1$ terminal, the above is then output at $OP_2$ of central control IC 13 after a $T_0$ delay so as to drive the flashing of group 2 lighting bulbs L2. The action of the lighting bulbs is shown in FIG. 3. Similarly, the action of group 3 and group 4 bulbs L3 and L4 starts after the flashing of group 1 bulbs L1 through a 2 $T_0$ and 3 $T_0$ time delay. The time delay $T_0$ is modulated by the second variable resistor SVR2. As with the above, if the switch SW is selected to drive bulbs group 2 to be flashed in a backward reversing direction with different sequence of flashing, a continuous tracing visual effect is thus formed.

Figure 4:
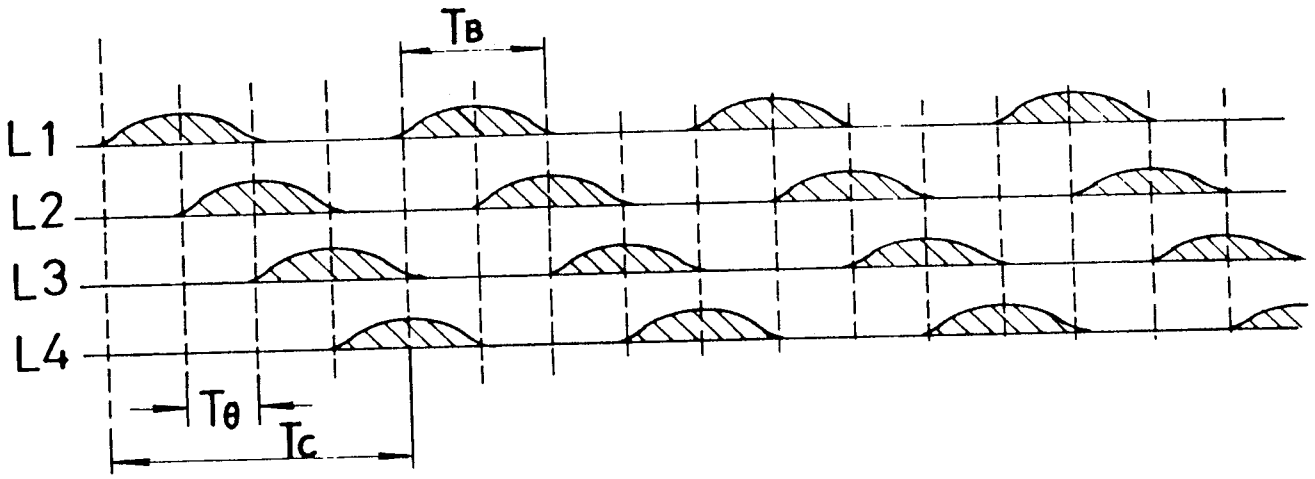
FIG. 4 is the pulse wave diagram of the series of flashing bulbs.

In a preferred embodiment of the present invention, as shown in FIG. 4, when the time delay $T_0$ is half of the PWM pulse period $T_B$, then the flashing of the bulbs is as that shown in the figure. After the first bulb of group L1 is lighted for $T_0$, the first bulb of the group L2 is then lighted. In the later half period after the first bulb of the group 4, L4 is lighted, the second bulb of group L1 is lighted simultaneously. The consequence for such a combination is that the bulbs of the two groups light up at the same time, and thus a continuous tracing effect of lighting is achieved. In accordance with the same principle, various type of lighting effect can be obtained by the variation of $T_B$ and $T_0$.

The central control integrated circuit 13 in accordance with the present invention can control bulb 2 so as to produce a fully lighted, forward tracing direction and reverse tracing direction of lighting. These functions are selected by the controlling switch SW. In addition, the variable resistor SVR3 of group three is used to adjust the time of forward or reverse lighting sequence.

It is to be understood that the forms of the invention herewith shown and described are to be taken as preferred examples of the same, and that various changes in the arrangement of parts may be resorted to, without departing from the spirit of the invention or scope of the claims.

I claim:

1. A continuous tracing light controller for controlling the flashing of a plurality of bulbs, comprising:

a bridge rectifier for the conversion of AC to DC;

an inverter phase circuit for the reverting of the above obtained DC; and a programmable central control integrated circuit having a plurality of output terminals for the individual controlling of bulbs in series, a three-step switch and 3 variable resistors which can control the light bulbs full-lighted, forward tracing direction and reverse tracing direction of lighting being connected to said control Integrated Circuit;

after the input voltage through said bridge rectifier, a part thereof being input into said programmable central control Integrated Circuit after passing through said inverted phase circuit, another portion of the current being input into a signal which synchronized with the voltage to said programmable central control Integrated Circuit by a branch input, by means of Pulse Width Modulation in sampling said synchronized signal producing an output signal to control the flashing of bulbs;

a time delay means being provided to the central control Integrated Circuit for delaying said output signal for a period and being output at the second output of the central control Integrated Circuit to control the flashing of the bulbs in second group similarly, after a time delay, said output signal being provided at the third output to control the third serial bulbs group; the number of outputs depending on the number of serial bulbs; and the first variable resistor connected by the central control Integrated Circuit controlling the period of the Pulse Width Modulation, the second variable resistor controlling the length of said time delay and the third variable resistor varying the time of forward or reverse lighting sequence.

* * * * *